US010265756B2

(12) United States Patent
Thielges et al.

(10) Patent No.: US 10,265,756 B2
(45) Date of Patent: Apr. 23, 2019

(54) PUNCH ASSEMBLY WITH STEEL PUNCH POINT INSERT REMOVABLY SECURED THEREIN

(75) Inventors: Bruce M. Thielges, Fridley, MN (US); Steve H. Thomson, Milaca, MN (US); Mitchell I. Elsmore, Cottage Grove, MN (US)

(73) Assignee: Mate Precision Tooling, Inc., Anoka, MN (US)

( * ) Notice: Subject to any disclaimer, the term of this patent is extended or adjusted under 35 U.S.C. 154(b) by 78 days.

(21) Appl. No.: 13/366,642

(22) Filed: Feb. 6, 2012

(65) Prior Publication Data

US 2013/0199352 A1 Aug. 8, 2013

(51) Int. Cl.

| | |
|---|---|
| ***B21D 28/34*** | (2006.01) |
| ***B26D 7/26*** | (2006.01) |
| ***B26D 1/14*** | (2006.01) |
| ***B26F 1/14*** | (2006.01) |

(52) U.S. Cl.

CPC ..... *B21D 28/34* (2013.01); *B26D 7/2614* (2013.01); *B26F 1/14* (2013.01); *Y10T 83/9423* (2015.04); *Y10T 83/9428* (2015.04); *Y10T 83/9476* (2015.04)

(58) Field of Classification Search

CPC ..... B26D 28/34; B26D 7/26; B26D 7/2614; B26D 7/2621; B26D 2007/2607; B21D 28/34; B21D 28/46; B21D 28/346; B21D 37/04; B21D 28/24; B21D 28/26; B26F 1/14; B26F 1/02; B30B 15/026; Y10T 83/9423; Y10T 83/9425; Y10T 83/9428; Y10T 83/943; Y10T 83/9437; Y10T 83/944; Y10T 83/9461; Y10T 83/9476

USPC ..... 83/698.91, 698.31, 684–687, 690, 691; 279/89, 904

See application file for complete search history.

(56) References Cited

U.S. PATENT DOCUMENTS

| | | | |
|---|---|---|---|
| 945,930 | A | 1/1910 | Gamble |
| 1,291,640 | A | 1/1919 | Desmond |
| 1,563,671 | A | 12/1925 | Spengler |
| 2,160,676 | A | 5/1939 | Richard |

(Continued)

FOREIGN PATENT DOCUMENTS

| | | |
|---|---|---|
| BE | 20010755 | 7/2004 |
| DE | 19508091 | 4/1996 |

(Continued)

OTHER PUBLICATIONS

Notification Concerning Transmittal of International Preliminary Report on Patentability, International Preliminary Report on Patentability, Written Opinion of the International Searching Authority dated Aug. 21, 2014 in corresponding International Application No. PCT/US2013/022465, 8 pages.

*Primary Examiner* — Clark F Dexter
(74) *Attorney, Agent, or Firm* — Thomas J. Nikolai; DeWitt LLP

(57) ABSTRACT

A punch assembly for a turret-type punch press includes an outer guide sleeve having an inner bore in which a punch shank fits for reciprocating but not rotating movement. The punch shank has a concentric, downward opening formed in a lower end in which is received a head portion of an insert that has a punch point formed on it. Built into the shank is a latching mechanism for releasably wedging and thereby securing the insert to the lower end of the shank.

8 Claims, 11 Drawing Sheets

(56) References Cited

U.S. PATENT DOCUMENTS

| | | | | | |
|---|---|---|---|---|---|
| 2,172,272 | A | | 9/1939 | Booth | |
| 2,323,756 | A | | 7/1943 | Smith | |
| 2,431,566 | A | * | 11/1947 | Kopczynski | B21D 28/34 83/686 |
| 2,614,781 | A | | 10/1952 | Engel | |
| 3,137,193 | A | | 6/1964 | Whistler | |
| 3,234,840 | A | * | 2/1966 | Smeets | B21D 28/24 83/559 |
| 3,429,212 | A | | 2/1969 | Weisback | |
| 3,495,493 | A | | 2/1970 | Herb | |
| 3,530,750 | A | | 9/1970 | Daniels | |
| 3,548,700 | A | | 12/1970 | Herzog | |
| 3,600,999 | A | | 8/1971 | Daniels | |
| 3,762,264 | A | * | 10/1973 | Scott | B21D 28/34 279/4.12 |
| 3,974,728 | A | | 8/1976 | Herlan | |
| 4,257,292 | A | | 3/1981 | Faull | |
| 4,257,300 | A | * | 3/1981 | Muzik | B02C 18/0007 83/146 |
| 4,577,875 | A | | 3/1986 | Miyakawa | |
| 4,708,548 | A | | 11/1987 | Taylor | |
| 4,718,161 | A | | 1/1988 | Pfister | |
| 4,745,674 | A | | 5/1988 | Abe | |
| 4,843,931 | A | | 7/1989 | Whistler | |
| 4,850,755 | A | | 7/1989 | Spencer | |
| 4,858,939 | A | | 8/1989 | Riggs | |
| 4,862,782 | A | | 9/1989 | Ernst | |
| 5,188,378 | A | | 2/1993 | Erlenkeuser | |
| 5,329,835 | A | | 7/1994 | Timp | |
| 5,746,104 | A | | 5/1998 | Russell | |
| 5,752,424 | A | | 5/1998 | Rosene | |
| 5,832,798 | A | | 11/1998 | Schneider | |
| 5,839,183 | A | | 11/1998 | Powlett | |
| 5,934,165 | A | | 8/1999 | Chatham | |
| 6,047,621 | A | | 4/2000 | Dries | |
| 6,182,545 | B1 | | 2/2001 | Janek, Jr. | |
| 6,196,103 | B1 | | 3/2001 | Schneider | |
| 6,205,358 | B1 | | 3/2001 | Haeg | |
| 6,334,381 | B1 | | 1/2002 | Chatham | |
| 6,669,399 | B2 | | 12/2003 | Janek, Jr. | |
| 6,981,327 | B2 | | 1/2006 | Nordlin | |
| 7,069,765 | B2 | | 7/2006 | Grove | |
| 7,159,426 | B1 | * | 1/2007 | Ghiran | B21D 26/035 29/421.1 |
| 7,168,356 | B2 | | 1/2007 | Rosene | |
| 7,228,776 | B2 | | 6/2007 | Case | |
| 7,975,587 | B2 | | 7/2011 | Schneider | |
| 8,707,841 | B2 | * | 4/2014 | Morehead et al. | 83/686 |
| 2002/0007714 | A1 | | 1/2002 | Ohtsuka | |
| 2004/0255742 | A1 | | 12/2004 | Morehead | |
| 2006/0169118 | A1 | | 8/2006 | Morehead | |
| 2007/0101849 | A1 | | 5/2007 | Moellering | |
| 2010/0107832 | A1 | | 5/2010 | Johnston | |
| 2010/0107846 | A1 | | 5/2010 | Lee | |
| 2011/0072948 | A1 | | 3/2011 | Belyan | |
| 2013/0118331 | A1 | * | 5/2013 | Morehead et al. | 83/686 |

FOREIGN PATENT DOCUMENTS

| | | | | | |
|---|---|---|---|---|---|
| DE | 19643194 | | | 4/1998 | |
| DE | 19949554 | | | 5/2001 | |
| DE | 10030614 | | | 1/2002 | |
| DE | 10060339 | | | 6/2002 | |
| DE | 10261748 | | | 7/2004 | |
| DE | 102006005572 | | | 6/2006 | |
| EP | 1657034 | A1 | | 5/2006 | |
| FR | 1479370 | | * | 5/1967 | B21D 28/34 |
| WO | WO8911932 | | | 12/1989 | |
| WO | WO0245924 | | | 6/2002 | |
| WO | WO2004060620 | | | 7/2004 | |

* cited by examiner

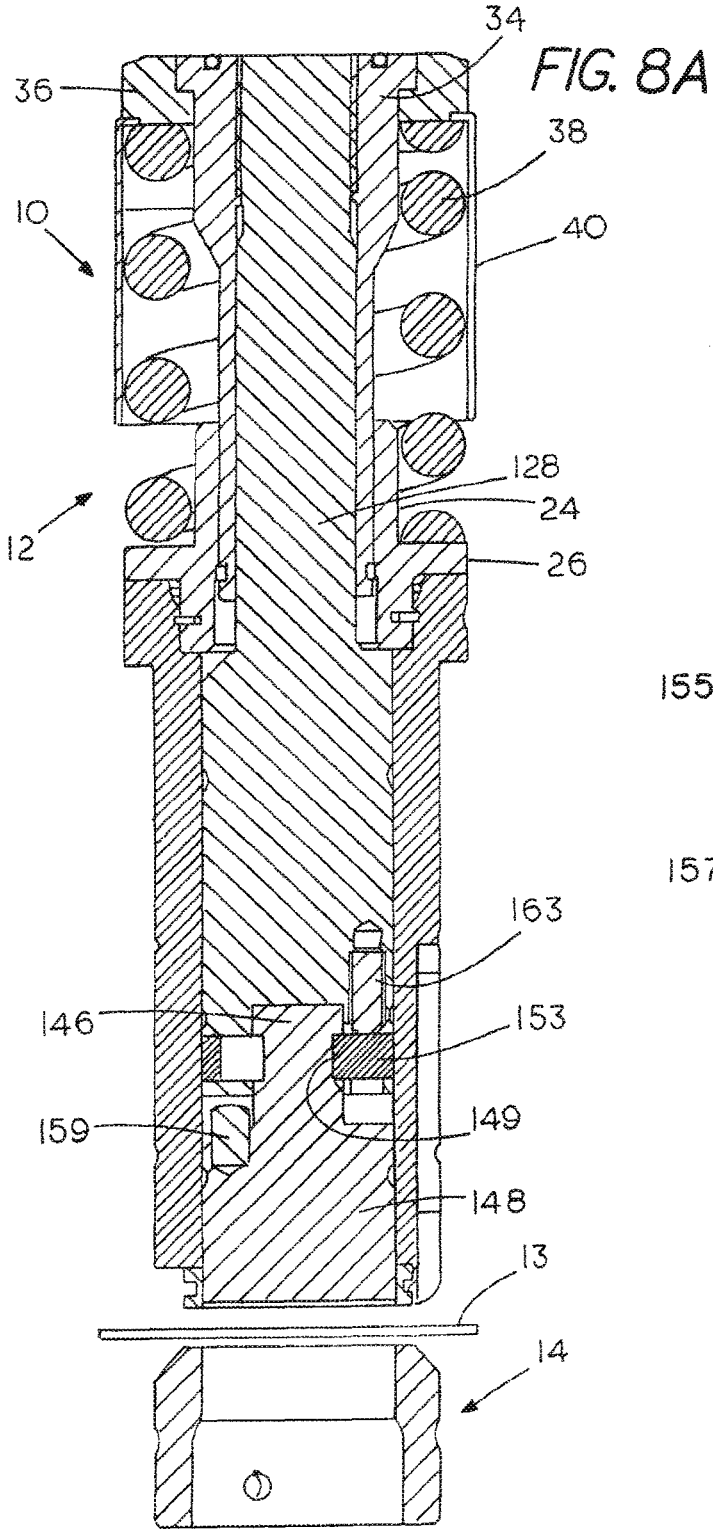
FIG. 8A
FIG. 9
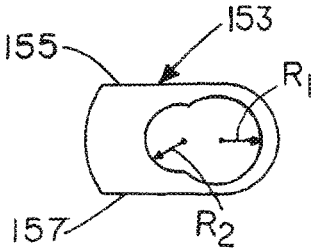

PUNCH ASSEMBLY WITH STEEL PUNCH POINT INSERT REMOVABLY SECURED THEREIN

BACKGROUND OF THE INVENTION

I. Field of the Invention

The present invention relates generally to metal working tools, and more particularly to metal punch assemblies used in high speed, turret-type punch presses.

II. Discussion of the Prior Art

As is well known in the art, turret-type punch presses typically comprise an upper rotatable disk carrying a plurality of punch assemblies of varying sizes and shapes and a lower rotatable disk carrying a plurality of dies, each including a through-bore also of varying sizes and shapes. The workpiece commonly is a piece of sheet metal that is disposed between the punch assemblies and the dies. The turrets are made to rotate under computer control until a programmably selected punch assembly is aligned across the workpiece with a programmably selected die at a desired orbital location, whereupon the punch is driven through the workpiece into the die.

A punch assembly commonly comprises an outer punch guide member having a longitudinal bore formed through it and disposed in the bore, and confined to reciprocating, but often non-rotating movement is a punch member comprising a shank with a punch point affixed to it. Also, it is known to provide a heavy return spring operatively disposed between the shank and the punch guide member that returns the punch member to its raised position following a punching stroke.

As a matter of economics, it is also a known practice to have a two-piece punch, having a low-cost steel shank to which is releasably attached a more expensive, hardened, tool-steel punch point member. It is the punch point member that engages the workpiece and drives a slug through a die during operation of the machine.

After repeated strokes, the punch point member may become dull and require sharpening or replacement. In order not to slow down production, a need exists for a way to quickly remove and replace a punch point member from and onto its shank.

Although the prior art discloses various ways of coupling a punch point member to its shank in forming a punch assembly, a need persists for a design that helps assure efficient removal and replacement of a punch point member from its shank.

SUMMARY OF THE INVENTION

In accordance with the invention, there is provided a punch and die assembly for use in turret-type punch presses in which the punch assembly comprises an outer guide sleeve adapted to be mounted on the punch press. Mounted for reciprocal, but often non-rotating motion within the guide sleeve is a punch shank having an insert carrying a punch point removably affixed at a lower end thereof for forming or punching a workpiece. Located at the lower end of the guide sleeve is a stripper element having an opening therethrough that is aligned with an insert having a punch point to enable the insert to pass through the opening so as to engage the workpiece. The insert comprises an element that is separable from the shank and that has an upwardly extending head portion formed thereon. The shank, in turn, has a downwardly opening recess therein to receive the head portion of the removable insert. A manually or tool operable latch element is mounted within the punch shank above the insert for engagement with the head. The latch element has at least one laterally moveable locking surface positioned to engage a confronting, downwardly facing cooperating locking surface forming a part of the head of the insert. The latch element is constructed and arranged on the punch shank to engage the head of the insert for forcing the locking surface of the latch to contact the head with an interference fit so as to eliminate clearance therebetween. At least one moveable operating button or knob is operatively connected to the latch element for pressing the latch element to an insert engaging position that holds the head of the insert stationary within the downwardly facing opening in the lower end of the punch shank. A port is provided in the sidewall of the punch shank. Just inside this port is provided an actuator element in a manually accessible position for moving the latch element to an operating position that secures the insert in its installed location as well as for later moving it to a releasing position which allows the insert to be removed.

Because of this arrangement, once the punch press assembly is stopped, an operator can, with or without the use of any hand tool, operate the latch element to free its engagement with the head of the insert carrying the punch point, allowing the insert to be removed. A replacement insert can be added by merely inserting the head thereof into the downwardly opening recess in the punch shank and manually or with the use of a tool lock it in place. An alignment key may be provided that projects from one of the shank and punch point insert into a mating aperture in the other to prevent relative rotation between the punch point insert and the shank.

The replaceable insert can be tool steel or tungsten carbide capable of long wear resistance when used for punching holes in sheets of a variety of metal and composite materials.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views review to corresponding parts.

FIG. 8A is a sectional view with the shank and latch of FIG. 8 disposed within a guide like that of FIG. 1;

FIG. 9 is a plan view of the latch element employed in the embodiments of FIGS. 7 and 8;

DESCRIPTION OF THE PREFERRED EMBODIMENT

Figure 1:
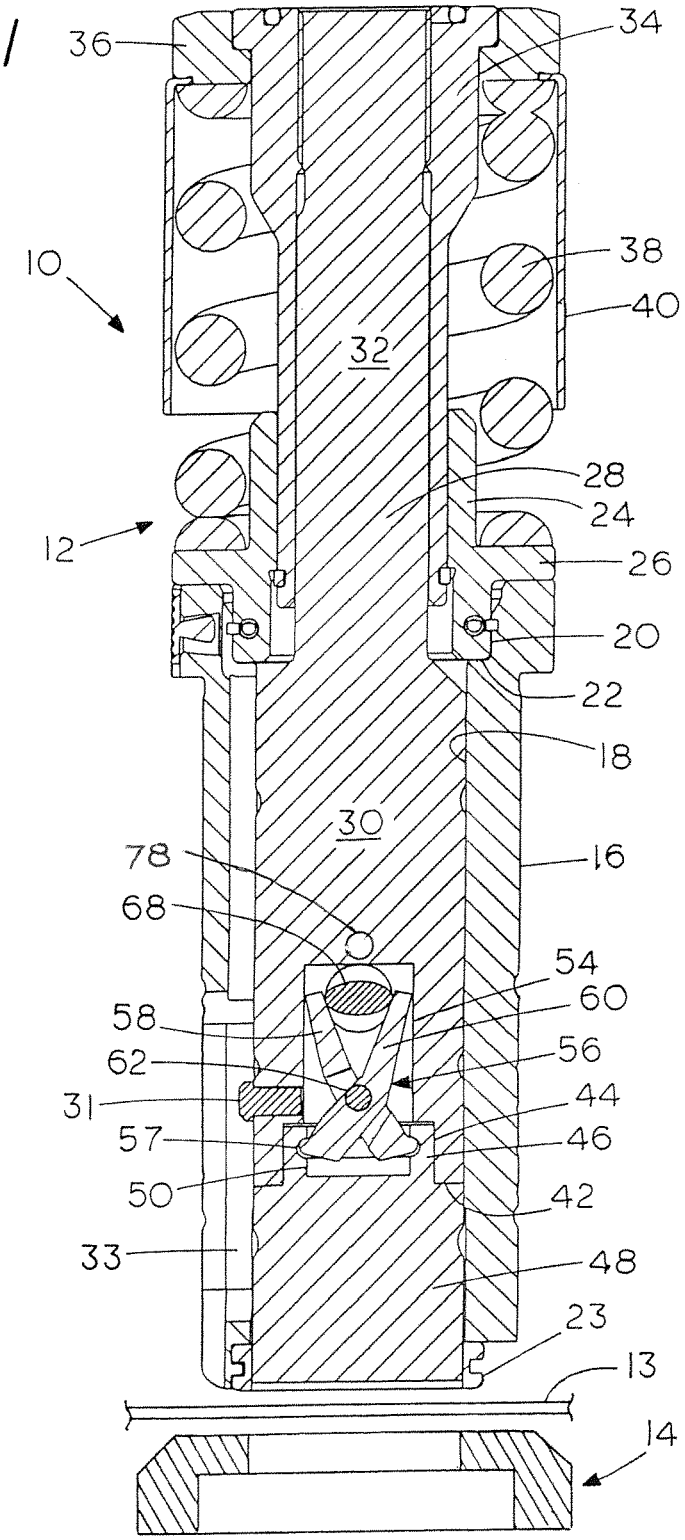
FIG. 1 is a longitudinal cross-sectional view of a punch and die assembly constructed in accordance with a first preferred embodiment of the invention.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

Indicated generally by numeral 10 is a punch and die assembly for use in a turret type punch press. The punch portion of the assembly is in indicated by numeral 12, the associated die by numeral 14 and a workpiece by numeral 13. The assembly 12 is seen to comprise a guide sleeve 16 in which is formed a longitudinally extending concentric bore 18 and a counterbore 20 of a larger diameter than the bore 18 so as to define an annular shoulder 22. A conventional stripper element 23 attaches to the lower end of the guide sleeve 16.

Concentrically disposed on the annular shoulder 22 is a nipple 24 which is generally tubular and has a radial flange 26 extending outwardly from its periphery.

Located for sliding movement within the bore 18 of the guide member 16 is a punch shank 28, typically formed from a relatively low-cost steel having a lower portion 30 whose outer diameter is such as to provide a close, sliding fit with the internal diameter of the bore 18. The upper portion of the punch shank 28 is labeled with reference numeral 32 and is seen to be of a lesser diameter than the lower portion 30. This is one possible general shape of a punch shank. This embodiment is not to be restricted to this exact style of punch shank but to be of any punch shank configuration known in the art. To prevent relative rotation of the punch shank 28 within its guide sleeve 16, a key 31 projects out from the punch shank proximate its lower end and rides in a vertical slot 33 formed in the guide sleeve.

Fitted over the upper portion 32 of the shank is a cap 34 whose outer diameter provides a sliding fit with respect to the internal diameter of the tubular nipple 24. Spring cap 36 is joined to the upper end of the cap 34. Operatively disposed between the spring cap 36 and the flange 26 of the nipple 24 is a return spring 38. A covering canister 40 surrounds the return spring 38.

The lower end 42 of the punch shank 28 has a downwardly opening recess 44 and removably fitted within the recess 44 is the head 46 of an insert 48 on which a sharpened punch point is formed. The insert 48 with its punch point will be formed from a high grade alloy tool steel, or tungsten carbide, more capable of maintaining a sharp edge over time than the steel used in fabricating the shank 28.

Figure 2:
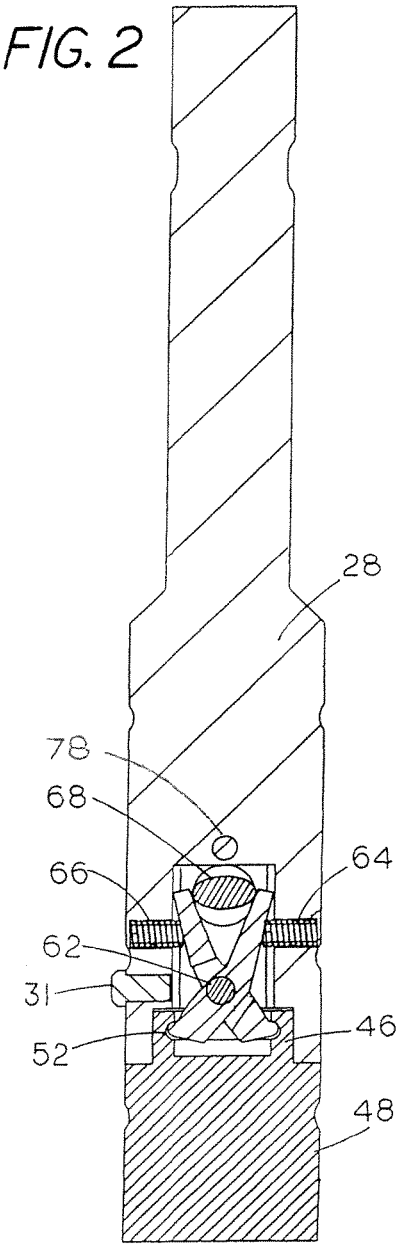
FIG. 2 is a cross-sectional view of a punch shank and a punch insert in their latched configuration.
Figure 3:
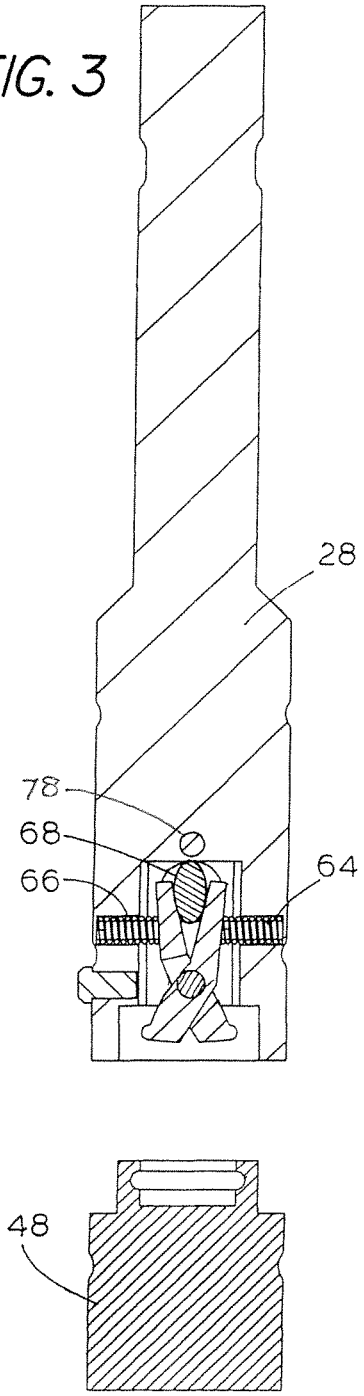
FIG. 3 is a cross-sectional view like that of FIG. 2 but with the punch point insert disengaged from the shank.

In the embodiment of FIGS. 1-3, a first type of latching mechanism is used to releasably hold the insert 48 against the lower end 42 of the shank 28. In this arrangement, the head or head portion 44 of the insert 48 includes a concentric bore 50 having an annular groove 52 in the sidewall thereof. Contained within a cavity 54 formed in the lower end portion 30 of the shank 28 is a manually operable latch element 56 comprising a pair of latch levers 58, 60 that are pivotally joined to one another proximate their respective midpoints by a dowel pin 62. As seen in FIG. 2, small compression springs 64, 66 operate to normally urge lever tips 57 at the lower ends of the latch levers 58, 60 to a release position as best illustrated in FIG. 3. Here, the lever tips 57 are disengaged from the annular groove 52 formed in the head 46 of the insert 48. A somewhat oval-shaped cam 68 is placed between the upper ends of the latch levers 58 and 60. The cam 68 has a round supporting shaft 70 at its inner (left) end (FIG. 4) and at its right end has a circular dial plate 72 with an axially positioned oval-shaped actuation knob 73 in angular and axial alignment with cam 68 that can be easily gripped between a thumb and forefinger for turning the cam 68 which thus rotates on shaft 70 and the edge of dial plate 72 which serves as bearings. Knob 73 is recessed within an access port 76 in the sidewall of the shank 28. Alternately the knob 73 on shaft 70 can be actuated with a tool that fits over the knob on shaft 70 or if the knob includes a hex pocket 75 for hex wrench activation. When the oval cam 68 has its major axis extending between the upper ends of the latch levers 58 and 60. as shown in FIGS. 1 and 2 defining two cam lobes 180° apart, the lower ends of the latching levers are spread to engage and hold the insert within the downwardly extending opening in the bottom of the shank 28 with a wedging action on the upper edge of annular groove or recess 52 that removes any clearance between the insert 48 and the shank 28 at lower end 42. When the cam is rotated such that the minor axis of the oval is between the upper ends of the latching levers 58 and 60, the tips 57 at the lower ends of the latching levers no longer engage the annular groove or recess 52 in the head 46 of the insert 48, thus releasing it, as best illustrated in FIG. 3 of the drawings. The head 46 and opening 44 are of close tolerance to provide a precision slide fit for axial positioning.

Figure 4:
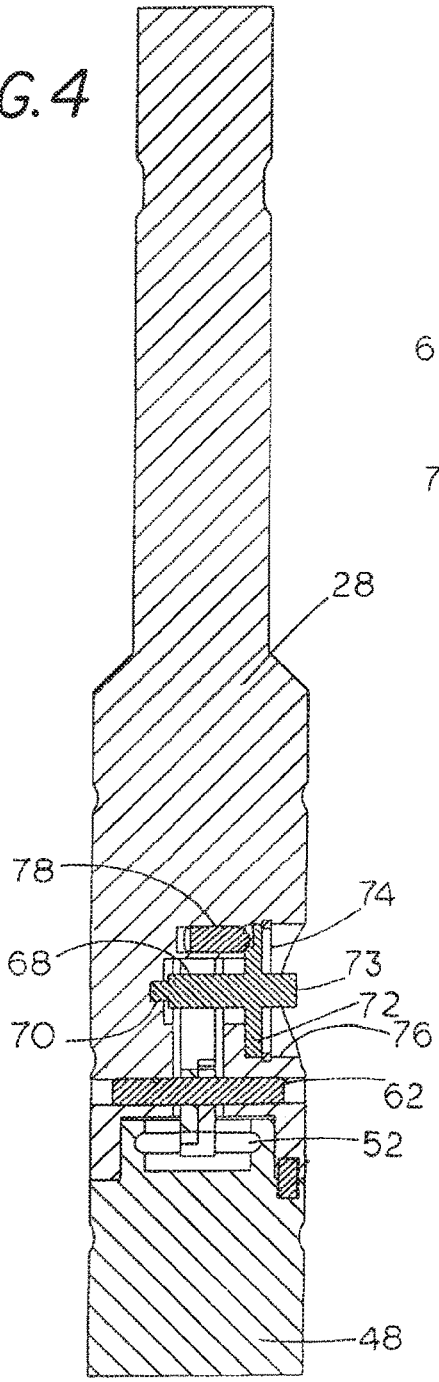
FIG. 4 is a cross-sectional view of the assembly of FIG. 3 along an orthogonal cutting plane.
Figure 4A:
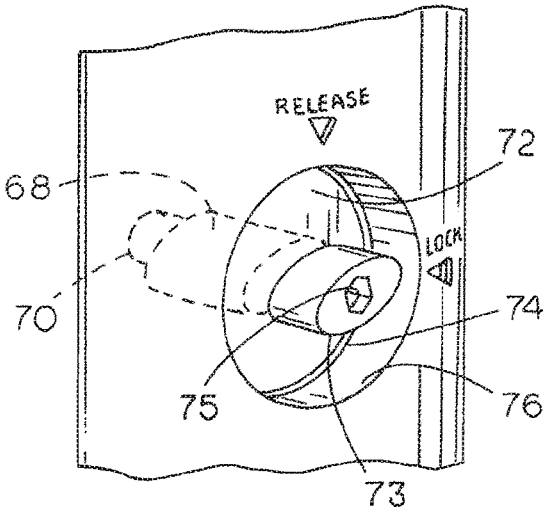
FIG. 4A is a orthogonal view of the knob used for the camming action in FIGS. 1-4.

The cross-sectional view shown in FIG. 4 is taken along a cutting plane orthogonal to that used in the view of FIG. 3 and, as such, better illustrates the cam actuating mechanism. The cam 68 is on a shaft 70 that has an annular flange 72 integrally formed therewith and held in place by a snap ring 74 that fits into an annular groove machined into a circular aperture forming the access port 76 in the shank body 28. A ball spring detent 78 cooperates with the flange 72 to provide a friction force that prevents unintended rotation of the cam 68 during operation of the punch press. This is a preferred method of controlling unintended rotation of the knob.

To actuate the cam and therefore the engagement or release of the punch point insert relative to the shank, an operator merely exposes the shaft, then inserts a thumb and forefinger or tool into the port 76 to grip the knob 73 and turn it, overcoming the resistance afforded by the spring ball detent 78 or similar type securing device.

Figure 5:
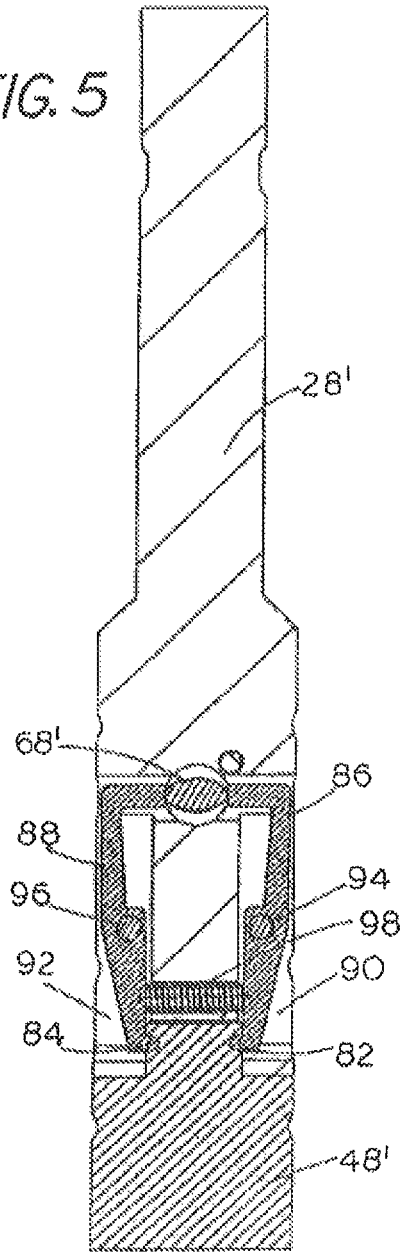
FIG. 5 is a cross-sectional view of an alternative embodiment of the invention showing a punch insert latched to its shank.
Figure 6:
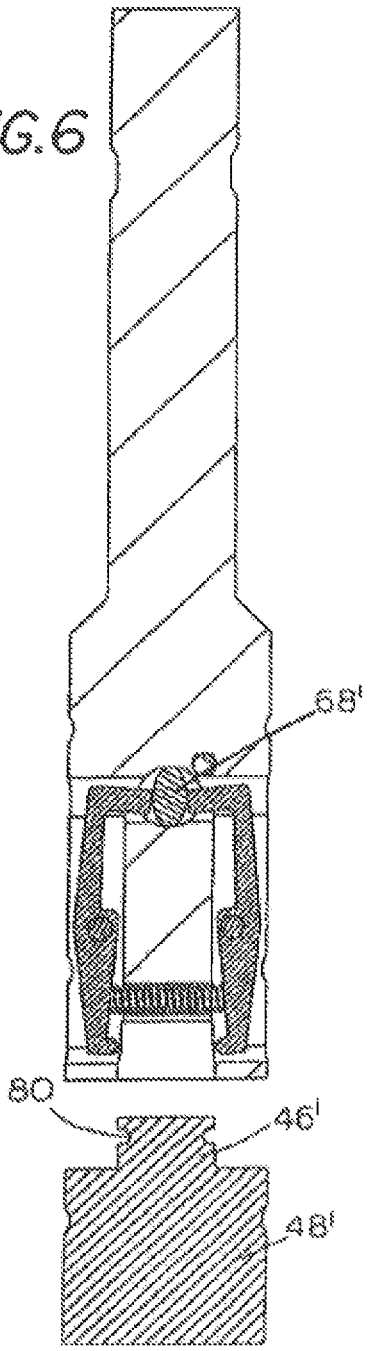
FIG. 6 is a view like that of FIG. 5 but with the punch insert detached.

Referring next to FIGS. 5 and 6, there is illustrated an alternative embodiment of a quick release, manually or tool operable latch element that is mounted within the punch shank above the insert carrying the punch point for engagement with the head of that insert. In this embodiment, the head or head portion 46' of the insert 48' includes an annular groove 80 in the periphery thereof that is adapted to be gripped by fingers 82, 84 on the lower ends of latch levers 86 and 88, respectively. The latch levers 86 and 88 are individually pivotally mounted by dowel pins 94 and 96 within slots or cutouts 90 and 92 milled or otherwise formed inwardly from the periphery of the shank. A compression spring 98 normally biases the lower portions of the latching levers 86 and 88 apart from one another to the insert disengaged position shown in FIG. 6. As in the embodiment of FIGS. 1-3, an oval cam 68' with two cam lobes 180° apart that is adapted to be turned by a knob (not shown) cooperates with in-turned portions of the latch levers proximate the upper ends thereof to spread those end portions apart and thereby cause the fingers 82 and 84 at the lower ends of the latch levers 86 and 88 to engage the upper aspect of the annular groove or recess 80 formed on the head 46' of the punch point insert 48' with a wedging action so as to provide a transition fit which removes any clearance between the insert 48' and the punch shank 28'. A "transition fit" is generally defined as one having limits of size so prescribed that either a clearance or an interference may result when mating parts are assembled.

With reference to FIGS. 5 and 6, then, when the major axis of the oval earn is horizontal, the lower ends of the latch elements engage and grip the head of the insert. When the cam is rotated such that the major axis of the oval cam is vertical, the head of the insert is no longer engaged by the latching fingers and can be readily removed for replacement.

Figure 7:
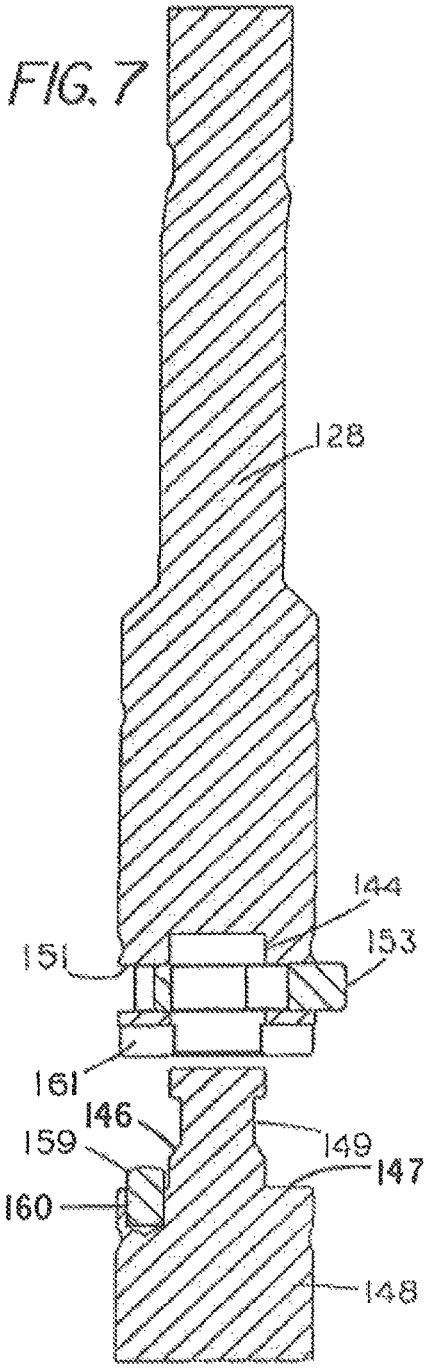
FIG. 7 is a cross-sectional view of a further alternative embodiment with a latching element in its released position relative to a punch insert.
Figure 8:
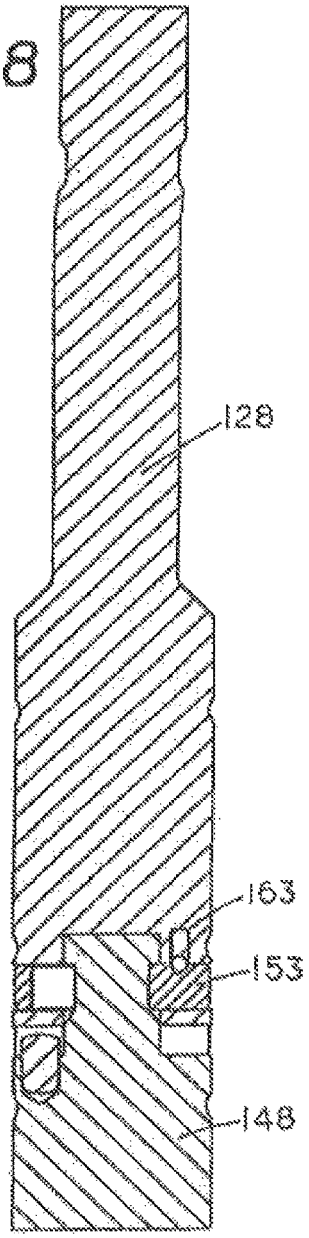
FIG. 8 is a view like that of FIG. 7 but with the latch element in the insert engaging position.

Turning next to FIGS. 7-9, a further embodiment or species of the invention is disclosed. Here again, the punch shank 128 is designed to be surrounded by a guide sleeve like that shown in FIG. 1 so as to be slidably movable therein. This embodiment is again not restricted to this exact style of punch and is applicable to any self-contained punch assembly known in the art that is adapted for installation into a turret style punch press. It is designed to have an insert 148 carrying a punch point mountable at a lower end thereof where the insert comprises a separate, removable element having an upwardly extending head or head portion 146. This head portion is designed to fit within a downwardly opening recess 144 at the bottom end of the shank 128. The head 146 extends upwardly from a shoulder portion 147 of the insert 148 and includes a necked down segment 149 of a reduced diameter. The head 146 is designed such that when it is fully inserted into the opening 144, the neck portion 149 becomes aligned with a slot 151 that extends through a central portion of the shank 128. Fitted into the slot is a slidable latching member 153 more clearly shown in the plan view thereof of FIG. 9. The latching member or latch plate 153 includes opposed parallel sides 155 and 157 and is preferably formed from steel plate material. Formed through the thickness dimension of the plate material are two overlapping circular apertures of radiuses R1 and R2 where R1 is greater than R2. Radius R1 is slightly greater than the outer diameter of the head portion 146 of the insert 148 while the radius R2 is only slightly larger than the diameter of the neck portion 149 of the insert.

With the latching member 153 positioned as shown in FIG. 7, the head 146 of the insert 148 can be fitted through the larger radiused opening $R_1$ and when the slidable necked-down portion of the latching element is pushed to the left as shown in FIG. 8, the head of the insert is partially surrounded by the metal of the latching member defining the aperture of radius $R_1$ and is thus retained within the downward opening in the shank to effectively lock the two together.

Because it is necessary to maintain alignment between the punch shank and its associated insert, a key member 159 may be used that is fitted into a bore 160 formed in the insert 148 and the key 159 is of a sufficient length such that when the insert is fully latched within the downward opening of the shank as illustrated in FIG. 8, a portion of the key fits into a corresponding bore 161 formed inward of the bottom surface of the shank 128. Of course, the key and slot could also be reversed.

To inhibit inadvertent movement of the latching mechanism 153 before installation into the punch guide 16 (FIG. 1), it has been found convenient to provide a spring ball detent 163 (FIG. 8) where the ball is able to fall into a dimple formed in the top surface of the slidable latching member 153. Alternatively, a ramp surface may be formed on the slidable latching member to create a tight wedging action with the shank that creates a transition fit which removes any clearance between the insert 148 and the shank 128.

Alternately, springs could also be used to pull or push the latch to hold the latch in the engaged position. When installed in the punch guide as shown in FIG. 8A it can be seen that the internal sidewall of the punch guide will prevent lateral movement of the latch to keep it securely engaged with the punch insert head.

From what has been described, those skilled in the art can appreciate that the insert 148 can be quickly and easily detached from the shank by merely sliding the latching member 153 so that its larger radius opening, $R_1$, is centered with respect to the head portion 146 of the insert. Replacement involves just the opposite maneuver. The head of the insert member 146 is fully inserted into the downwardly directed opening 144 in the shank followed by pressing the slide member 153 such that the material defining the smaller aperture of radius, $R_2$, partially surrounds the necked down portion 149 of the head 146.

Figure 10:
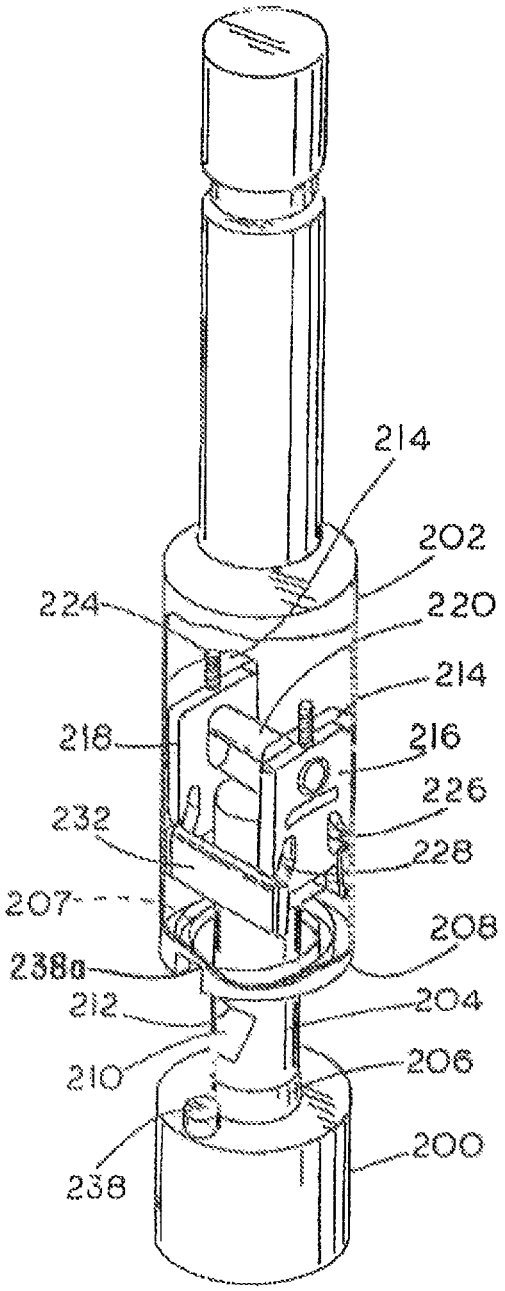
FIG. 10 is a break-away view illustrating a still further alternative embodiment.
Figure 13:
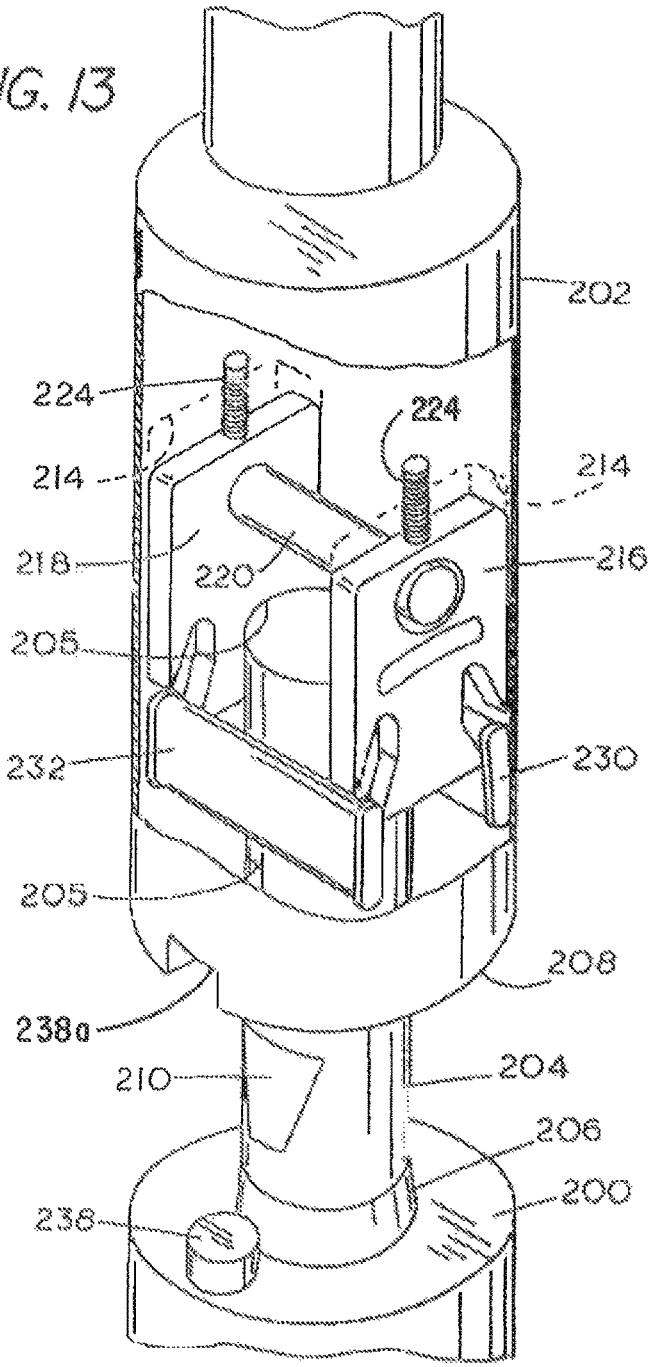
FIG. 13 is a partial breakaway view of the center part of FIG. 10 on a larger scale.

Shown in FIG. 10 is a perspective view of the shank and insert elements of a punch and die assembly that incorporates a further approach for releasably latching the insert having the punch point with a tool shank. In FIG. 10, the insert 200 is shown detached from the shank 202. As in the previously described embodiments, the insert 200 has an integrally formed head or head portion 204. Here, the head includes a conical base segment 206 adapted to mate with a conical segment of a central bore 205 in FIG. 13 formed inward from a bottom surface 208 of the punch shank 202. Additionally, a trepan groove 207 located at the bottom 208 of the shank and strategically positioned near the cone of the central bore 205 allows for material compliance to allow the punch shank and insert to align cylindrically into high concentric centering due to the material compliance when locked together. This is important for applications such as thin sheet metal where an accurate mating of the punch and die is required due to reduced clearance between punch and die.

The bore 205 of the shank and the diameter of the head 204 of the insert serves as a second precision cylindrically centering fit to offer a redundant fit only slightly less precise than the conical fit such that the additional fit provides support in heavy side loading applications such as nibbling.

Figure 11:
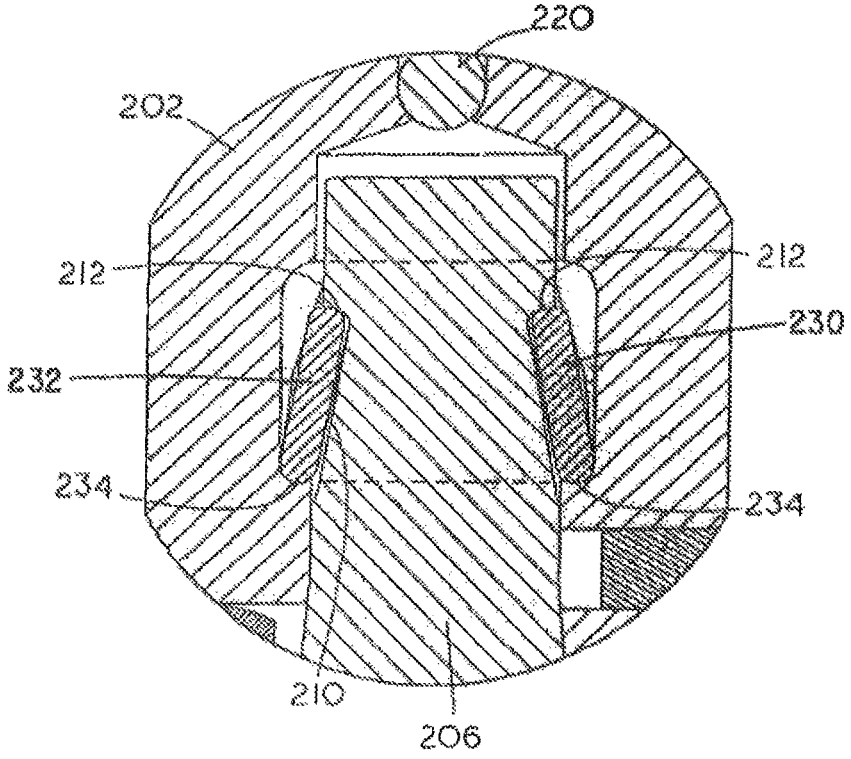
FIG. 11 is a greatly enlarged, partial, sectional view of the embodiment of FIG. 10.

A cylindrical upper portion of the head 204 of the insert includes inwardly and upwardly tapered recesses on diametrically opposed surfaces thereof, only one being visible in FIG. 10 and identified by numeral 210. These recesses terminate in a horizontal edge 212 as best seen in FIG. 11.

Figure 12:
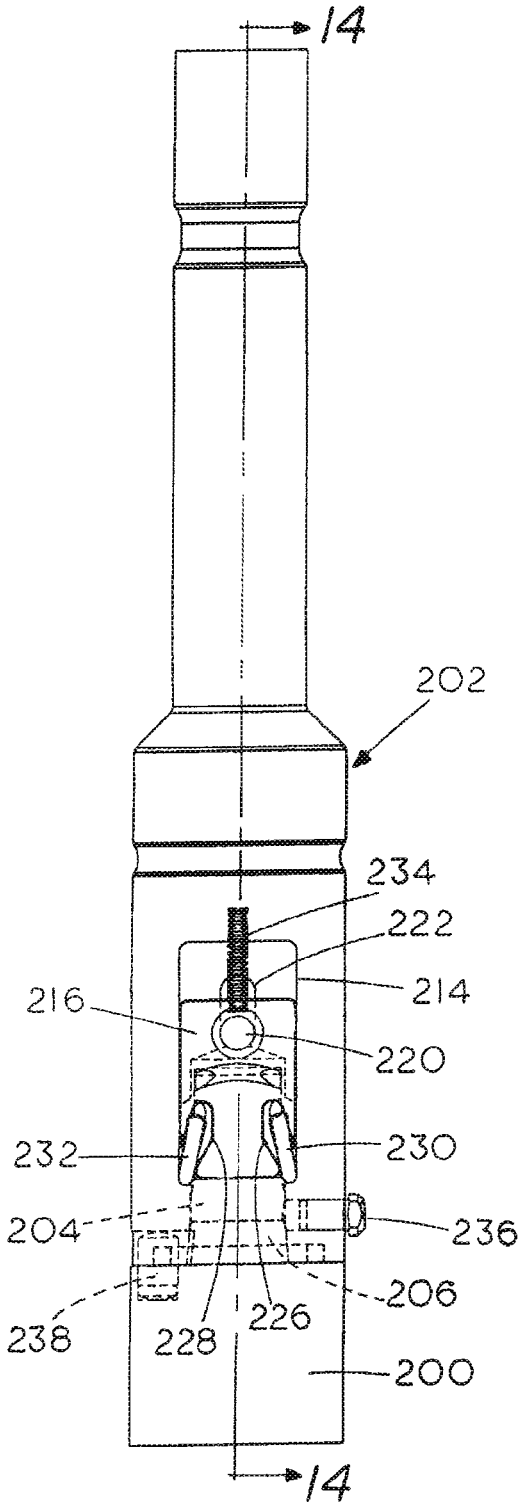
FIG. 12 is a side elevation of the embodiment of FIG. 10.

Milled into the periphery of the shank 202 at diametrically opposite locations are first and second rectangular pockets or recesses, as at 214 in FIG. 12, that are arranged to contain a pair of slidable actuators 216 and 218 that are joined to one another by a dowel pin 220 that passes through a vertical slot 222 formed internal to the shank 202. This permits the slidable actuators 216 and 218 to be manually displaced up and down within their pockets 214. Compression springs 224 normally bias the slidable actuators downward when viewed as in FIG. 10.

Each of the slidable actuators includes a pair of cam slots 226, 228 into which latch plates 230, 232 are fitted. The length of the latch plates is such that they extend the distance between the pair of associated slidable actuators 216 and 218. The cam slots are shaped such that when the slidable actuators are in their down position, the latch plates become wedged between the horizontal edge 212 on the head of the insert and an arcuate groove 234 formed in the shank 202 that provides a transition fit, preventing removal of the insert 200 from the shank 202. When the slidable actuators 216 and 218 are elevated, the camming action of the cam slots 226, 228 on the latch plates pivots the latch plates in the grooves 234 so that their upper edges no longer abut the horizontal edge 212 on the shank, allowing the insert to be removed from the bore in the shank 202.

Figure 14:
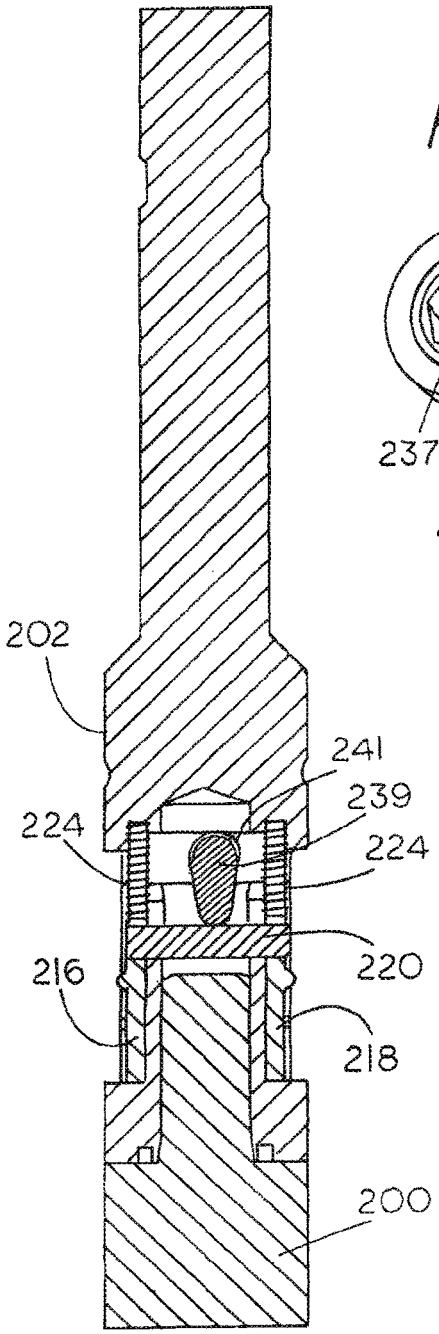
FIG. 14 is a cross-sectional view taken along the line 14-14 in FIG. 12.
Figure 16:
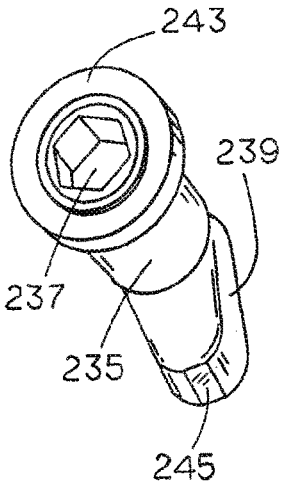
FIG. 16 is a perspective view of the actuator cam employed.
Figure 15:
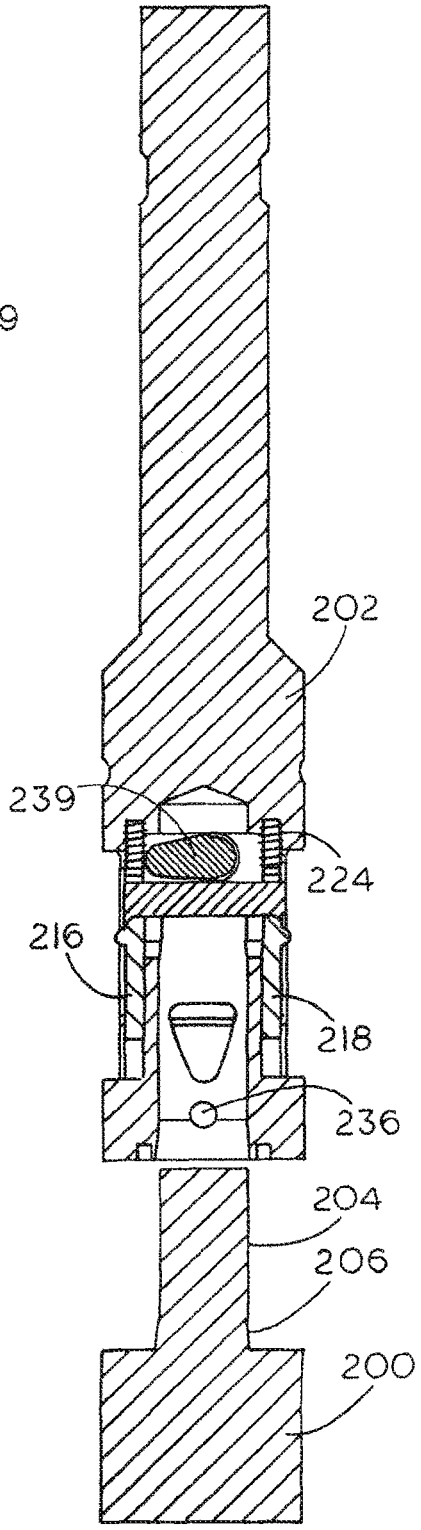
FIG. 15 is a view like FIG. 14 but with the insert disconnected from the shank.

FIGS. 14 and 15 are included to illustrate the manner in which a manual or tool operated locking cam shown in FIG. 16 is made to cooperate with the dowel pin 220 to move the slidable actuators 216 and 218 between a first position in which the insert 200 is locked to the bottom of the shank 202 (FIG. 14) and in an alternative position in which the insert 200 is released from its shank (FIG. 15). As can be seen in FIG. 16, the locking cam comprises a cylindrical shaft portion 235 having a hex socket 237 formed inward from one end thereof and a transversely extending cam 239 depending from an opposite end thereof. The shaft portion 235 is arranged to fit through and rotate within a bore 241 formed in the shank as seen in the cross-sectional view of FIG. 14. The hex socket 237 permits an Allen wrench to be used to rotate the locking cam 239. Optionally, a knob 243 may be affixed to the end of the shaft 235 to facilitate rotation of the locking cam without the aid of a tool.

As seen in FIGS. 14 and 15, the locking cam 239 is adapted to cooperate with the dowel pin 220 and when rotated to the position shown in FIG. 14 urges the slidable actuators 216 and 218 to their punch point insert locking disposition against the resistance afforded by the tension springs 224. When the locking cam 239 is rotated 90° to the position shown in FIG. 15, the tension springs 224 function to lift the slidable actuators 216 and 218 to the elevated disposition in which the punch point insert 200 is released from the shank.

Referring again to FIG. 16, it has been found effective to provide a flat segment 245 on the otherwise rounded end of the locking cam 239. By providing this flat area 245, a resistance is offered to inhibit unintended rotation of the locking cam from the disposition shown in FIG. 14 to that shown in FIG. 15.

To maintain a desired alignment of the shank within its guide member, a first key 236 in FIG. 12 is provided that is arranged to fit into aligned keyway 33 in the punch guide as is shown in FIG. 1. Likewise, on such arrangement to maintain a desired alignment of the punch insert 200 relative to the shank 202, a second key or pin 238 is provided in the punch insert 200 that fits into aligned keyways **238*a* in the bottom of the shank 202 adjacent the head 204**.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A punch assembly for use in a punch press where there is an opening for holding the punch assembly, said punch assembly comprising:

a guide sleeve with a central bore and having first and second ends, the guide sleeve adapted to be mounted on the punch press;

a nipple with a radial flange, the nipple being attached to said first end of the guide sleeve and having a longitudinal bore of a predetermined diameter;

a punch shank removably inserted in the central bore of the guide sleeve for sliding movement in the guide sleeve and with a removable punch insert at a lower end of the punch shank for punching a workpiece;

said removable punch insert comprising a punching portion and a cylindrical head portion extending upwardly from the punching portion, the cylindrical head portion having a diameter that is less than a diameter of the punching portion thereby defining a shoulder therebetween, and where the diameter of the punching portion at the shoulder is the same as an outer diameter at the lower end of the punch shank thereby offering a precise alignment of the punch insert within the guide sleeve, the head portion having a circumferential groove formed thereon, said punch shank having a downwardly opening recess therein that removably receives the head portion of the removable punch insert therein, said punch shank also having an access slot in a sidewall thereof leading to the recess;

a latch plate slidably disposed within the access slot in the punch shank and at a location of the circumferential groove of the punch insert, said latch plate being manually slidable within the access slot, without the use of a tool, from a punch insert release position to a punch insert latched position, said latch plate having first and second intersecting bores formed therethrough of radii $R_1$ and $R_2$, respectively, where the bore of radius $R_1$ is sufficiently large to receive the head portion of the removable punch insert therethrough in the release position, and the bore of radius $R_2$ is smaller than the head portion and is sized to receive the circumferential groove therein in the latched position, the arrangement being such that the removable punch insert can be inserted and removed from the downwardly opening recess in the punch shank through the bore of radius $R_1$ when the latch plate is in the release position and the punch insert is locked in the recess when the latch plate is slid to the latched position with the bore of radius $R_2$ engaging the circumferential groove of the removable punch insert.

2. The punch assembly of claim 1 and further including a detent member operatively disposed between the punch shank and the latch plate for constraining the latch plate to bistable movement of the latch plate toward the latched or release position.

3. The punch assembly of claim 1 and further including an alignment key affixed to one of the removable punch insert and the punch shank for fitting into a recess formed in the other of the removable punch insert and the punch shank to facilitate precise orientation within the punch press when said punch insert has a non-cylindrical cross-sectioned shape.

4. The punch assembly of claim 1 wherein the head portion of the removable punch insert has a predetermined clearance fit with said downwardly opening recess in the punch shank thereby offering a precise alignment of the punch insert within the punch shank.

5. The punch assembly of claim 1 wherein the latch plate is sized to conform to an inner diameter of the guide sleeve to securely restrict the latch plate to its latched position.

6. The punch assembly of claim 1 wherein the punch shank has a predetermined outer diameter over a lower portion thereof and a lesser diameter over an upper portion above the lower portion to define a transition surface at a junction point between the lower portion and the upper portion, the transition surface adapted to engage a lower end of the nipple to limit upward displacement of the punch shank within the guide sleeve.

7. The punch assembly of claim 6 and further including a cap member with a central bore fitted over the upper portion of the punch shank, the cap member having an outer diameter sized to create a sliding fit with the predetermined diameter of the nipple's longitudinal bore; a spring cap joined to an upper end of the cap member; and a compression coil return spring operatively disposed between the spring cap and the radial flange of the nipple.

8. The punch assembly of claim 7 and further including a canister joined to the spring cap and surrounding the return spring.

* * * * *